US005845679A

United States Patent [19]

Hayashi et al.

[11] Patent Number: 5,845,679

[45] Date of Patent: Dec. 8, 1998

[54] PILOT SELECTOR VALVE

[75] Inventors: Bunya Hayashi; Makoto Ishikawa, both of Yawara-mura, Japan

[73] Assignee: SMC Corporation, Tokyo, Japan

[21] Appl. No.: 891,297

[22] Filed: Jul. 10, 1997

[30] Foreign Application Priority Data

Jul. 29, 1996 [JP] Japan ..... 8-216175

[51] Int. Cl.[6] ..... F15B 13/043; F15B 13/08

[52] U.S. Cl. ..... 137/625.64; 137/625.69; 137/884

[58] Field of Search ..... 137/625.64, 884, 137/625.69

[56] References Cited

U.S. PATENT DOCUMENTS 5,111,840 5/1992 Miller et al. .

FOREIGN PATENT DOCUMENTS 0 628 729 12/1994 European Pat. Off. .
0 661 484 7/1995 European Pat. Off. .
0 703 391 3/1996 European Pat. Off. .
0 719 949 7/1996 European Pat. Off. .

OTHER PUBLICATIONS

Patent Abstracts of Japan, AN 06 252871, Sep. 21, 1994, JP 08 093941, Apr. 12, 1996.

*Primary Examiner*—Gerald A. Michalsky
*Attorney, Agent, or Firm*—Oblon, Spivak, McClelland, Maier & Neustadt, P.C.

[57] ABSTRACT

In a pilot selector valve, a first output opening 25A in a valve hole 24 is opened relative to a first output channel 32*b* formed on the top surface of the valve body 18 using a first enlarged channel 32*a* with its width which is orthogonal to the connecting surface of the valve body is made larger than its width in the axial direction. The first output channel is formed by attaching a top cover 21 to the valve body 21. A second output opening 25B located opposite the first output channel is opened relative to the bottom surface of the valve body 18 using a second enlarged channel 33*a* similar to the first enlarged channel. A through hole 33*c* for allowing the second enlarged channel 33*a* to communicate with a second output port B is opened in the valve body with the opening end of the second enlarged channel 33*a* closed with a bottom.

6 Claims, 7 Drawing Sheets

PILOT SELECTOR VALVE

FIELD OF THE INVENTION

The present invention relates to a pilot selector valve.

PRIOR ART

The connection of a large number of pilot selector valves on rails is disclosed in, for example, Japanese Patent Application Laid Open No. 8-93941. Such a selector valve consists of a main valve 1 with a valve body 5 inserted into a valve hole 4 in a valve body 3; and two pilot solenoid valves 2A and 2B attached to both ends of the main valve for outputting a pilot fluid used to drive the valve body 5, as shown in FIG. 7. The main valve 1 includes a pressurized fluid supply channel P and ejection channels EA and EB that penetrate the main valve in the direction in which valve bodies 3 are connected together; and first and second output ports A and B directly opened on the top surface of the main body 3, with the supply and ejection channels P, EA, and EB and the two output ports A and B in communication with the valve hole 4. Through holes 6, 7A, and 7B die-formed so that they extend from the bottom surface of the valve body 3 through the supply and ejection channels P, EA, and EB to the valve hole 4 and are closed by a bottom cap 8, which allows the main valve 1 to be directly connected to a rail 9. Such a constitution is effective in simplifying the channels while enabling them to have large cross sections in the valve body 3 and in reducing the size of the overall configuration.

Conventional generally known pilot selector valves used to mount manifolds include a pair of output ports extending through channels in a manifold and opened below a pilot selector valve mounting position. Even a pilot selector valve such as that shown in FIG. 7, however, preferably includes a pair of output ports opened in the same direction as that of the pilot selector valve used to mount manifolds, that is, at one end surface of the main body 3 in the direction in which the valve hole 4 is opened, so as to be appropriately connected to fluid pressure equipment.

As a pilot selector valve that meets such requirements, Japanese Patent Application Laid Open No. 6-109156 discloses a pilot selector valve wherein two solenoid valves are disposed on one end surface of the main body in the direction in which the valve hole is opened, while a pair of output ports opened at the top surface of the valve body extends to the other end surface of the valve body via a piping adapter.

To output pressurized fluid from the pair of output ports opened at the top surface of the valve body, however, such a pilot selector valve requires an installation space on the valve body that is used for the piping adapter, and that is as large as that required for direct piping and connection to the output ports, thereby preventing the size of the main body from being reduced.

In addition, when a pair of output ports are formed at one end surface of the valve body in the direction in which the valve hole is opened while channels extending from the output opening of the valve hole to the output ports are opened by connecting holes together through machining, it is necessary to avoid interference not only with the supply and the ejection channels (P. EA, and EB in FIG. 7) penetrating the main valve in the direction in which valve bodies are connected but also with the channel carrying the pilot fluid. Thus, it is very difficult to open channels reaching the output ports, while narrowing the cross-section area of the channels (the diameters of the holes) and thus a reduced flow therein. As a result, the size of the valve body must be increased to increase the cross sections and the flow.

SUMMARY OF THE INVENTION

It is an object of this invention to provide a pilot selector valve comprising two pilot valves provided at one end surface of a main body in the direction in which a valve hole is opened; and a pair of output ports opened at the opposite end surface of the valve body, which enables an output passage extending from the output opening of the valve hole to the output ports and a pilot fluid channel to be routed easily, particularly, so as to bypass the other channels, and which allows the channels to have a large cross section, while permitting a compact structure, in order to prevent the flow from being substantially less than that of the conventional example shown in FIG. 7.

To achieve this object, this invention provides a pilot selector valve that consists of a main valve with a valve body inserted into a valve hole in a valve body in which main valves can be connected on a connecting surface parallel to the axis of the valve hole; and a single pilot valve or two pilot valves for driving and returning which are attached to one end of the valve body in the direction in which the valve hole is opened, said main valve allowing supply and ejection openings for pressurized fluid that open into the valve hole to communicate with supply and ejection channels that penetrate the valve body in the direction in which valve bodies are connected and allowing first and second output openings that open into the valve hole to communicate with output ports opened at the other end of the valve body in the direction in which the valve hole is opened so as to use a pilot fluid output from the pilot valve to drive the valve body of the main valve to switch the first and second output ports between the supply and the ejection channels for communication, wherein the first output opening in the valve body on the pilot valve mounting side is opened relative to a first output channel formed on the top surface of the valve body using a first enlarged channel with a square cross section and with its width in the axial direction of the valve hole sufficiently increased between sealants located on both sides of the output opening or with its width in orthogonal to the connecting surface of the valve body made larger than its width in the axial direction of the valve hole, wherein a through hole for allowing the first output channel to communicate with the first output port is opened in the valve body so that the first output channel formed by attaching a top cover to the valve body can be used to allow the first enlarged channel to communicate with the through hole, wherein the second output opening located opposite the first output channel is opened relative to the bottom surface of the valve body using a second enlarged channel similar to the first enlarged channel, and wherein a through hole for allowing the second enlarged channel to communicate with a second output port is opened in the valve body with the opening end of the second enlarged channel closed by a bottom cover attached to the bottom surface of the valve body.

In this pilot selector valve, at the top surface of valve body, a pilot output through hole through which pilot fluid output from the second pilot valve is introduced can be formed relative to a second pilot output channel formed in parallel to the first output channel by attaching the top cover, and a pilot output through hole can be opened to allow the second pilot output channel to communicate with a piston chamber at the end of the valve body located opposite the pilot valve mounting side of the valve body.

In addition, a pilot supply channel that penetrates the valve body in the direction in which valve bodies are connected can be formed to supply pilot fluid to the pilot valve, or an engagement section can be installed on the bottom cover to engage the valve body with a rail to make connections.

In the pilot selector valve according to this invention, which has this configuration, the first output opening on the pilot valve mounting side of the valve body is opened relative to the first output channel formed on the top surface of the valve body using the first enlarged channel with a square cross section formed so as to be as large as possible and preferably with a width orthogonal to the connecting surface of the valve body larger than the width in the axial direction, the first output channel is in communication with the first output port channel via the through hole, the top surface of the first output channel is closed by the top cover, and the second output opening is in communication with the second output port via a similar enlarged channel. Thus, although the pilot selector valve is small and includes supply and ejection channels that penetrate the valve body in the direction in which pilot selector valves are connected; and a pair of output ports opened at one end of the valve body in the direction in which the valve hole is opened, it enables the output passage extending from the output opening of the valve hole to the output ports to be routed easily, and allows the channels to have a large cross section while permitting a compact structure in order to prevent the flow from being substantially less than that of conventional examples. This is true of the channel for allowing pilot fluid output from the second pilot valve in the valve body to communicate with the piston chamber located opposite the pilot valve mounting side of the valve body.

DESCRIPTION OF EMBODIMENTS

Figure 1:
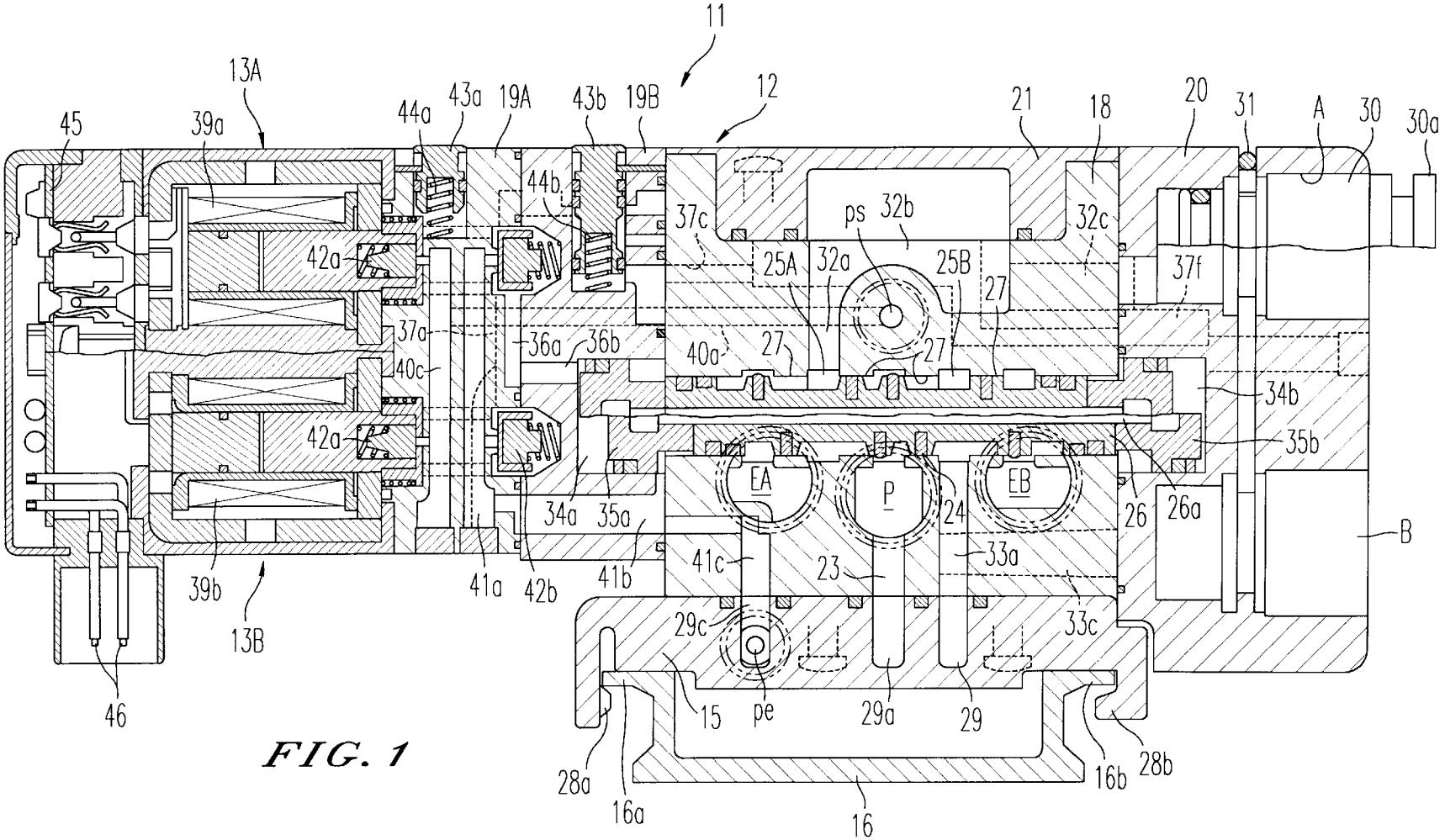
FIG. 1 is a vertical cross-sectional side view of a first embodiment of this invention.

FIGS. 1 to 5 show a first embodiment wherein a selector valve 11 is configured as a double pilot selector valve that includes a main valve 12 and two pilot solenoid valves 13A and 13B and wherein selector valves 11 can be connected on DIN (German Standard) rails 16 using a bottom cover 15.

A valve body 18 in the main valve 12 has a valve hole 24 opened therein into which a valve body 26 is inserted, and a plurality of valve bodies 18 can be sequentially connected on a connecting surface 18*a* parallel to the axis of the valve hole 24. First and second manual operation boxes 19A and 19B are attached to one end of the surface of the valve body in the direction in which the valve hole 24 is opened, an end plate 20 is attached to the other end, a top cover 21 is attached to the top surface, and the bottom cover 15 is attached to the bottom surface, using set screws 22 (see FIG. 2) in each case.

The valve body 18 includes a compressed-air supply channel P, first and second ejection channels EA and EB, and a pilot supply channel ps, all of which penetrate the valve body 18 in the direction in which pilot solenoid valves are connected together; and pressurized fluid supply and ejection openings opened into the valve hole 24. The supply channel P is in communication with the supply opening for the valve hole 24 via a supply through hole 23 that is die-formed so as to extend from the bottom surface of the valve body 18 through the valve body to the valve hole 24, and the ejection channels EA and EB are directly in communication with the ejection opening for the valve hole 24. In addition, first and second output openings 25A and 25B are formed between these openings opened into the valve hole 24. The valve body 26 inserted into the valve hole 24 in a sliding manner, uses pilot fluid to switch the first and second output openings 25A and 25B between the supply and the ejection channels P, EA, and EB for communication.

The ejection channels EA and EB can also be opened into the valve hole 24 using a through hole similar to the supply through hole 23, which is die-formed so as to extend from the bottom surface of the valve body 18 through the valve body to the valve hole 24.

First and second output ports A and B are vertically arranged in the outer surface of an end plate 20 attached to the valve body 18 in such a way that the first and the second output openings 25A and 25B opened into the valve hole 24 are in communication with the output ports A and B. This communication is based on the channeling shown in FIG. 5.

First, the first output opening 25A in the valve body 18 on the pilot valve mounting side is opened relative to a first output channel 32*b*, which is formed by attaching the top cover 21 to a recess in the top surface of the valve body 18, using a first enlarged channel 32*a* with a square cross section and with its width in the axial direction of the valve hole 24 sufficiently increased between sealants 27, 27 located on both sides of the output opening 25A or preferably with its width orthogonal to the connecting surface 18*a* of the valve body 18 made larger than its width in the axial direction of the valve hole 24. In addition, a through hole 32*c* that allows the first output channel 32*b* to communicate with the first output port A is opened in the valve body 18. Thus, pressurized fluid (compressed air) from the first output opening 25A is output from the first enlarged channel 32*a* through the first output channel 32*b*, while the through hole 32*c* is in communication with the first output port A.

On the other hand, the second output opening 25B located opposite the first output channel is opened relative to the bottom surface of the valve body 18 using a second enlarged channel 33*a* similar to the first enlarged channel 32*a*, which has a square cross section, and which has its width in the axial direction of the valve hole 24 sufficiently increased between sealants 27, 27 located on both sides of the output opening 25A or preferably its width orthogonal to the connecting surface 18*a* of the valve body 18 made larger than its width in the axial direction of the valve hole 24. A through hole 33*c* that allows the second enlarged channel 33*a* to communicate with a second output port B is opened in the valve body 18 with the opening end of the second enlarged channel 33*a* closed by a bottom cover 15 that is attached to the bottom surface of the valve body 18. Thus, pressurized fluid from the second output opening 25B is output from the second enlarged channel 33*a* through the through hole 33*c* to the second output port B.

The valve body 18 is formed of a die-cast aluminum alloy or a synthetic resin, and in this case, since the first and the second enlarged channels 32*a* and 33*a* are die-formed from above and below the valve body 18, a hole with a relatively large square cross section can be formed easily without the need for a drill to provide round holes. Furthermore, the enlarged channels can be formed easily so that the widths in the axial direction of the valve hole is sufficiently increased between sealants 27, 27 located on both sides of the first and the second output opening 25A and 25B in the valve hole 24 and so that its width orthogonal to the connecting surface 18*a* of the valve body 18 is made larger than its width in the axial direction of the valve hole 24. Furthermore, a bypass channel can be formed easily. In addition, the top and the bottom covers 21 and 15 are preferably formed of a synthetic resin.

A well known pipe joint 30 that is engaged with a flexible tube (not shown) when it is inserted, and that is disengaged from the tube to allow it to be removed when a release bush 30*a* is pressed is detachably mounted in the output ports A and B using a U-shaped fastener 31 that is inserted into a mounting groove 20*a* (see FIG. 2) formed on the outer circumference of the end plate 20.

The rail 16 on which the valve body 18 is mounted using the bottom cover 15 is like a cross-sectional channel, and it includes flanges 16*a* and 16*b* integrally formed in the width direction on both sides of the rail and with which engagement sections 28*a* and 28*b* of the bottom cover 15 are engaged.

The bottom cover 15 includes engagement sections 28*a* and 28*b* that elastically engage the flanges 16*a* and 16*b* of the rail 16; recesses (seal sections) 29*a* and 29*b* that close the supply through hole 23 and the second enlarged channel 33*a*, respectively, that are opened at the bottom surface of the valve body 18; a pilot ejection channel pe penetrates the valve body 18 in the direction in which valve bodies are connected; and an opening 29*c* that allows the pilot ejection channel pe to be opened on the top surface of the bottom cover. If through holes similar to the supply through hole 23 are formed for the ejection channels EA and EB, recesses (seal sections) that close the bottom ends of the through holes must be formed on the bottom cover 15. When a plurality of valve bodies 18 are connected, the pilot ejection channels pe are in communication with the supply, ejection, and pilot supply channels P, EA, EB, and ps in the same way that they are sealed.

A first piston 35*a* is inserted into a first piston chamber 34*a* formed in the second manual operation box 19B in an airtight and sliding manner, and a second piston 35*b* is inserted into a second piston chamber 34*b* formed on the end plate 20 in an airtight and sliding manner. When a pilot fluid is supplied from the first pilot output through hole 36*b* to the first piston chamber 34*a*, the first piston 35*a* and the valve body 26 move toward the right in FIG. 1, the supply channel P communicates with the first output opening 25A, and the second output opening 25B communicates with the second ejection channel EB (see the lower half of the valve body 26 in FIG. 1), thereby outputting pressurized fluid from the first output port A. In addition, when pilot fluid is supplied from the second pilot output through hole 37*f* to the second piston chamber 34*b* with pilot fluid ejected from the first piston chamber 34*a*, the second piston 35*b* and the valve body 26 move toward the left in FIG. 1, the supply channel P communicates with the second output opening 25B, and the first output opening 25A communicates with the first ejection channel EA (see the upper half of the valve body 26 in FIG. 1), thereby outputting pressurized fluid from the second output port B.

A first pilot solenoid valve 13A for driving the valve body 26 and a second pilot solenoid valve 13B for making the valve body 26 return are attached to the first manual operation box 19A with set screws 38 (see FIG. 2) in such a way that the solenoid valves are vertically arranged.

Each of the pilot solenoid valves 13A and 13B includes a pilot inlet port, a pilot outlet port, and a pilot exhaust port, and each is configured as a well known, normally closed, three-port solenoid valve switches the pilot output port between the pilot inlet port and the pilot exhaust port for communication by energizing and de-energizing the solenoids 39*a* and 39*b*.

Figure 5:
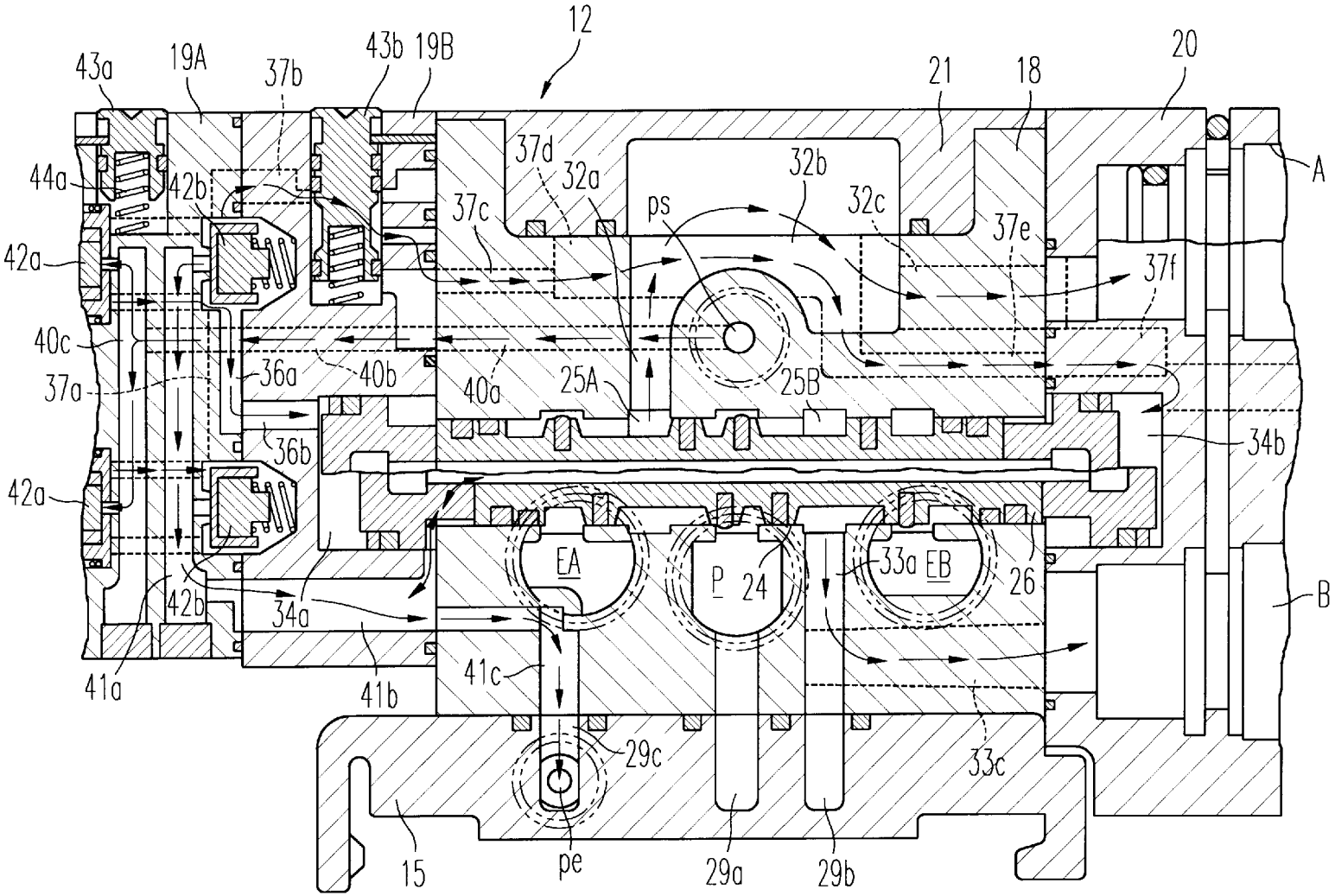
FIG. 5 describes the passage of fluid according to the first embodiment.

As shown in FIG. 5, pilot fluid is supplied from the pilot supply channel ps through the pilot supply passage 40*a* formed in the valve body 18 and through the pilot supply passages 40*b* and 40*c* formed in the second and first manual operation box 19B and 19A to the pilot inlet ports of the pilot solenoid valves 13A and 13B. The pilot output port in the solenoid valve 13A is in communication with the first piston chamber 34*a* through first pilot output through holes 36*a* and 36*b* formed in the manual operation boxes 19A and 19B. In addition, the pilot output port in the solenoid valve 13B is opened to an output channel 37*d* between the top surface of the valve body 18 and the top cover 21 through second pilot output through holes 37*a* and 37*b* formed in the manual operation boxes 19A and 19B and through a pilot output through hole 37*c* in the valve body 18, and is in communication with the second piston chamber 34*b* through second pilot output through holes 37*e* and 37*f* formed in the valve body 18 and the end plate 20.

On the other hand, each of the pilot exhaust ports in the solenoid valves 13A and 13B is in communication with the pilot ejection channel pe at the bottom cover 15 through pilot exhaust passages 41*a*, 41*b*, and 41*c* formed in the manual operation boxes 19A and 19B and the valve body 18.

The pilot supply passage 40*c* and pilot exhaust passage 41*a* in the manual operation box 19A are both opened from the bottom surface of the manual operation box 19A, and the openings at the bottom surface of these passages are closed by plugs.

The pilot supply channel ps can be formed on the top cover 21 or the pilot ejection channel pe can be formed on the valve body 18.

The pilot solenoid valves 13A and 13B include an inlet valve body 42*a* and an exhaust valve body 42*b* positioned on either side of the first manual operation box 19A, and are interlocked. When the solenoid 39*a* or 39*b* is energized, the inlet valve body 42*a* opens the pilot inlet port to allow the pilot supply passage 40*c* to communicate with the first or the second pilot output through hole 36*a* or 37*a*, and the exhaust valve body 42*b* closed the pilot exhaust port to block communication between the pilot output through hole 36*a* or 37*a* and the pilot exhaust passage 41*a*. When the solenoids 39*a* and 39*b* are de-energized, the exhaust valve body 42*b* opens the pilot exhaust port while the inlet valve body 42*a* closes the pilot inlet port.

Figure 2:
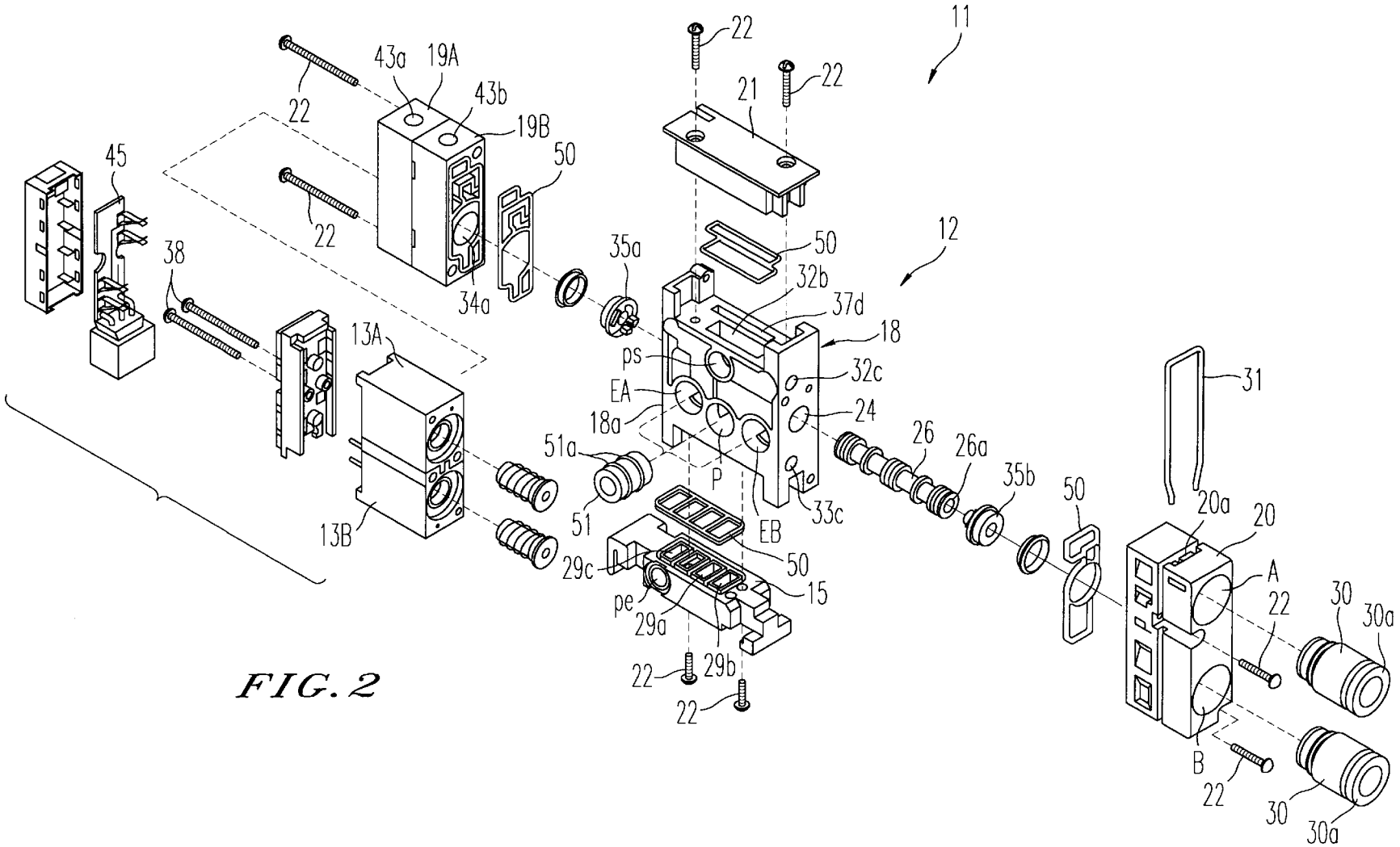
FIG. 2 is an exploded three-dimensional view of FIG. 1.
Figure 4:
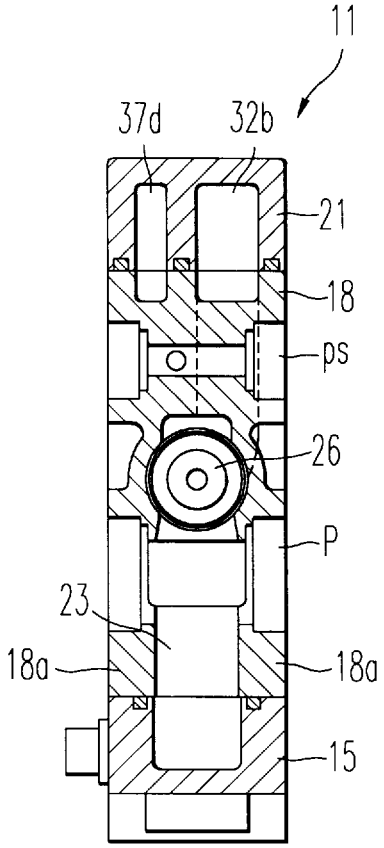
FIG. 4 is a cross-sectional view of the integral part of the first embodiment.

As shown in FIGS. 1, 2, and 4, the first output channel 32*b* and the second pilot output channel 37*d* are both opened on the top surface of the valve body 18, and these output channels consist of parallel grooves (see FIG. 4) formed on the top surface of the valve body 18 and on the bottom surface of the cover 21, which are aligned in the direction in which valve bodies are connected. Thus, even if the valve body 18 includes supply and ejection channels P, EA, and EB that penetrate the valve body in the direction in which the valve bodies are connected, the channel extending from the output openings 25A and 25B for the valve hole 24 to the output ports A and B and the channel extending from the second pilot solenoid valve 13B to the second piston chamber 34*b* can be routed very easily, and channels with large cross sections can be provided while permitting a compact structure.

First and second manual operation buttons 43*a* and 43*b* are formed in the first and the second manual operation boxes 19A and 19B so that the buttons can be pressed downward. The manual operation buttons 43*a* and 43*b* are normally energized upward by springs 44*a* and 44*b* in such a way that the first manual operation button 43*a* is in a standby position while the second operation button 43*b* blocks communication between the pilot supply passage 40*a* and the pilot output through hole 37*c*, as shown in FIG.

If an accident, such as a service interruption, prevents the valve body 26 from being driven by the solenoids 39*a* and 39*b* and the first manual operation button 43*a* is pressed against the energizing force of the spring 44*a*, then the inlet valve body 42*a* of the pilot solenoid valve 13A is directly pressed to open the channel extending from the pilot supply passage 40*c* to the pilot output through holes 36*a* and 36*b*. In addition, when the second manual operation button 43*b* is pressed against the energizing force of the spring 44*b*, the pilot supply passage 40*a* can be allowed to communicate with the pilot output through hole 37*c*.

Gus A feeding section 45 attached to a side of the pilot solenoid valves 13A and 13B has at its bottom end a receiving terminal 46, which is electrically connected to a feeding terminal (not shown) of a feeding line 49 introduced through a wiring passage 48 in a feeding box 47 (see FIG. 3) attached to the bottom of the pilot valve 13B.

A penetrating passage 26*a* that penetrates the valve body 26 in its axial direction allows a breather chamber in the valve body partitioned by pistons 35*a* and 35*b* to communicate with the pilot exhaust passage 41*b*. In FIG. 2, reference numeral 50 designates a gasket that seals the contacting surface of each member, 51 is a connecting member that is attached to the supply and the ejection channels P, EA, and EB of adjacent valve bodies 18, 18, and 51, 51*a* are seal members that are mounted on the outer circumference of the connecting member 51 to allow the channels to be in communication with each other in an airtight manner.

Figure 3:
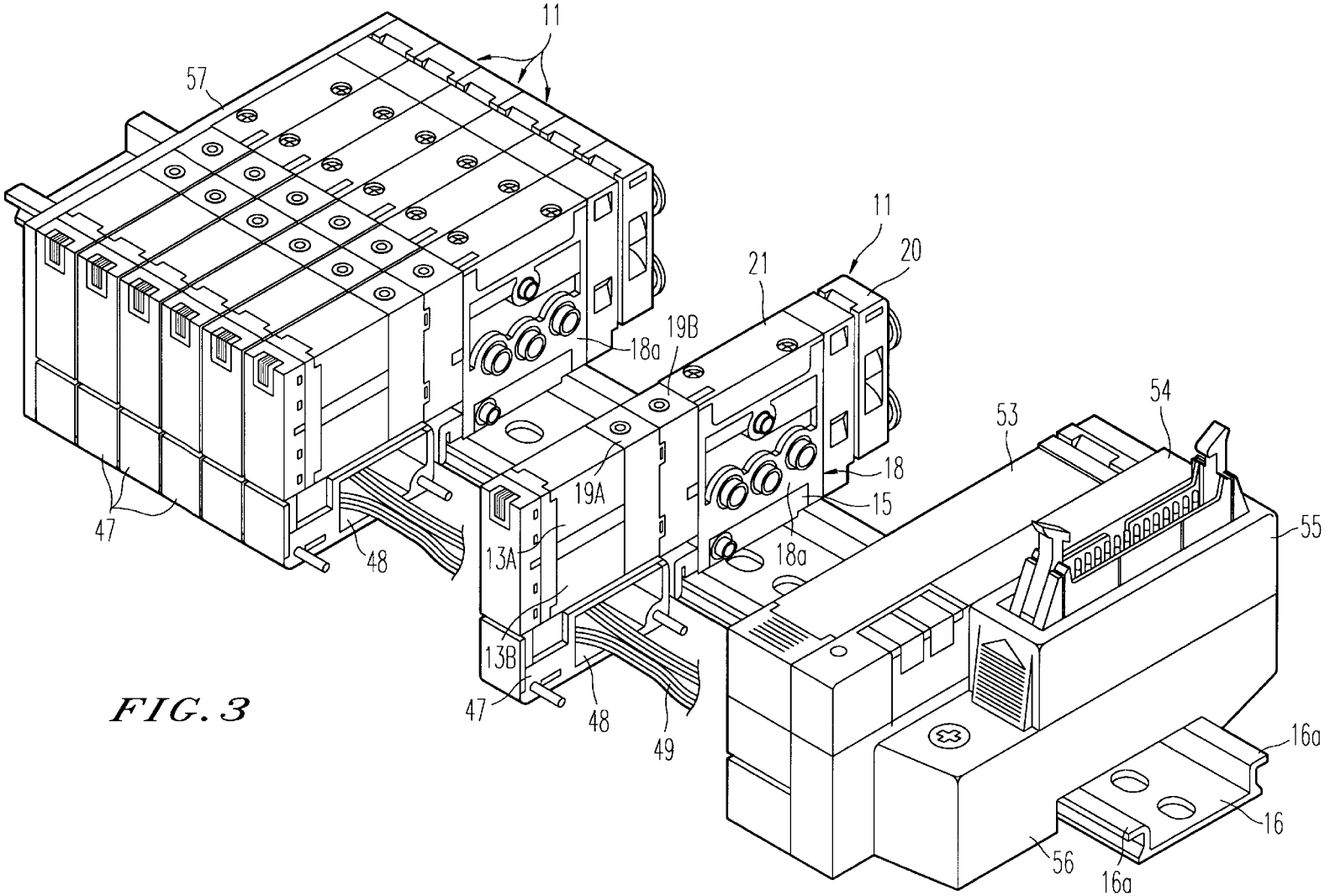
FIG. 3 is a three-dimensional view showing an aspect of this invention in which a large number of pilot selector valves are connected according to the first embodiment.

Furthermore, in FIG. 3, 53 is a supply-and-exhaust block provided on one end of the selector valve in the direction in which valve bodies are connected; 54 is a feeding block; 56 is a mount on which a multipole connector 55 is mounted; 57 is a side plate that contacts with the other end of the selector valve in the direction in which valve bodies are connected. These components are all fixed to the rail 16 with set screws together with connected selector valves.

In the pilot selector valve according to the first embodiment, when the solenoid 39*a* of the first pilot solenoid valve 13A is energized, pilot fluid supplied to the first piston chamber 34*a* causes the valve body 26 to slide, thereby causing the supply channel P to communicate with the first output opening 25A, and outputting compressed air from the first output port A. In addition, when the solenoid 39*a* is de-energized and the solenoid 39*b* of the second pilot solenoid valve 13B is energized, the pilot fluid is ejected from the first piston chamber 34*a*, while pilot fluid supplied to the second piston chamber 34*b* causes the valve body 26 to slide in the opposite direction, thereby causing supply channel P to communicate with the second output opening 25B, and outputting compressed air from the second output port B.

In this case, the first output channel 32*b* and the second pilot output channel 37*d* must be formed in the axial direction of the valve body 18, but these channels are opened at the top surface of the valve body 18 to communicate with the channels in the end plate 20 using parallel grooves at the top surface of the valve body 18 and at the bottom surface of the top cover 21 that covers the valve body 18. Consequently, these channels, and in particular, channels that bypass the pilot supply channel ps can be routed easily, and the cross sections of the channels can be adjusted so as to ensure the required flow.

Figure 6:
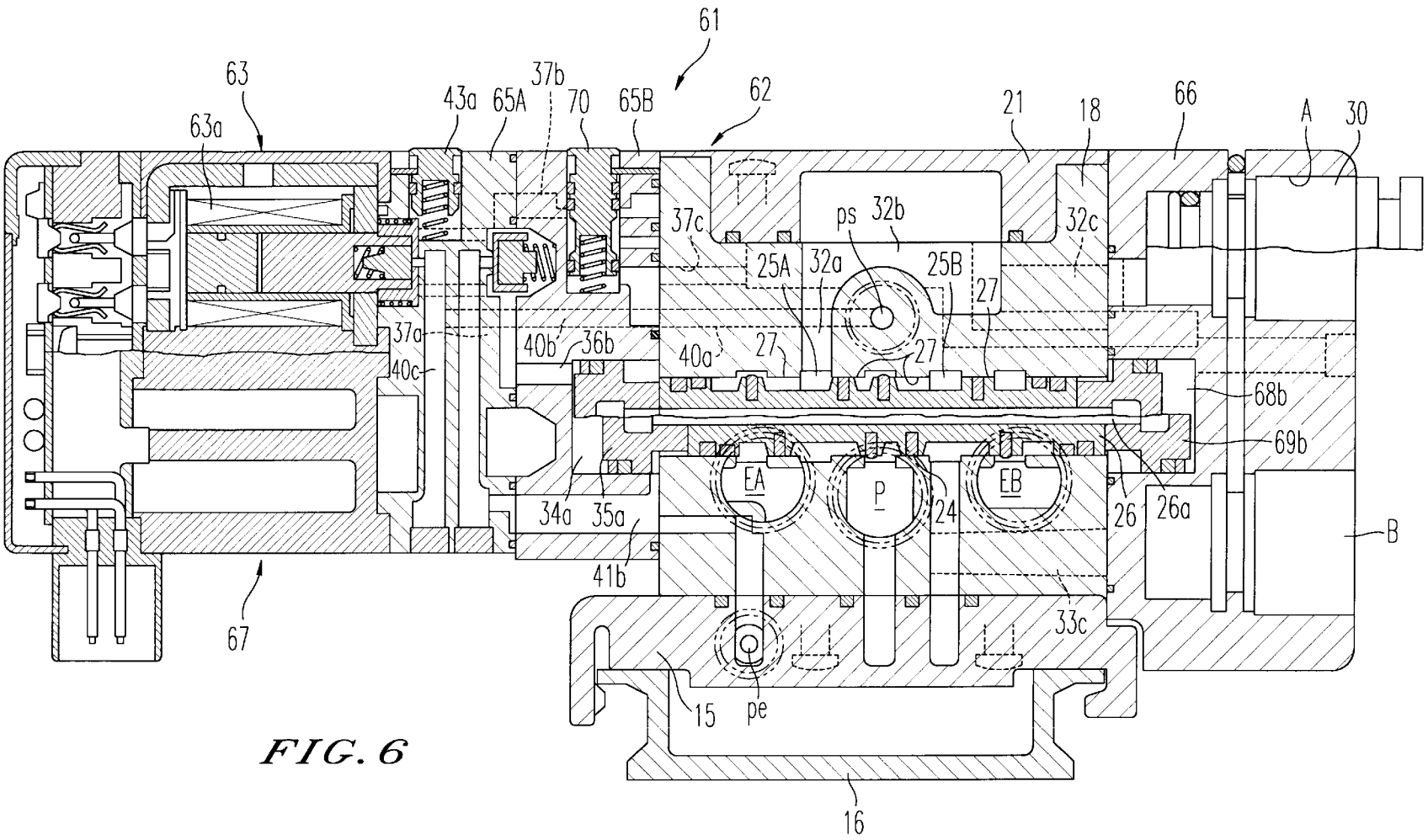
FIG. 6 is a vertical cross-sectional side view of a second embodiment.
Figure 7:
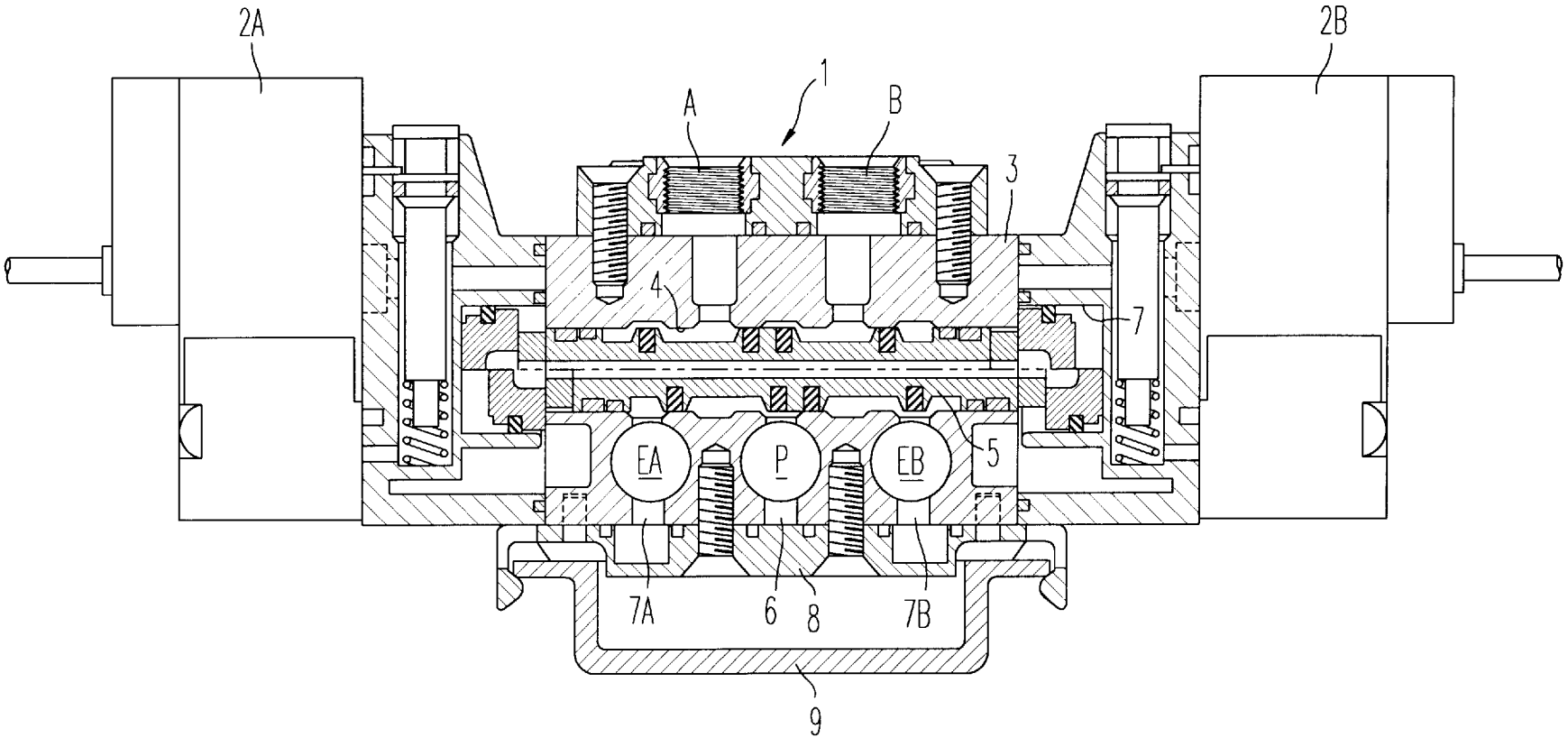
FIG. 7 PRIOR ART
FIG. 7 is a vertical cross-sectional side view of a publicly known selector valve.

FIG. 6 shows a second embodiment of this invention. Using as many of the same components used in selector valve 11 according to the first embodiment as possible, a selector valve 61 is configured as a single pilot selector valve, and includes a main valve 62 and a pilot solenoid valve 63 similar to those in the first embodiment, and can be connected to the rail 16 using the bottom cover 15.

The valve body 18 of the main valve 62 and the top cover 21 have the same configuration as in the first embodiment; therefore, the same main components in FIG. 6 have the same reference numbers.

In addition, first and second operation boxes 65A and 65B are attached to one axial-end surface of the valve body 18, an end plate 66 is attached to the other end surface, and the top and the bottom covers 21 and 15 are attached to the top and the bottom surfaces of the valve body, respectively. A pilot solenoid valve 63 with the same configuration as the first pilot solenoid valve 13A according to the first embodiment and a dummy body 67 with the same appearance as the second pilot solenoid valve 13B are attached to the first manual operation box 65A.

The end plate 66 has the same configuration as the end plate 20 according to this invention except that the former includes a second piston chamber 68*b* with a smaller diameter than the first piston chamber 34*a* and a second piston 69*b* with a smaller diameter than the first piston 35*a*.

In addition, the first manual operation box 65A has the same configuration as the first manual operation box 19A according to the first embodiment, except that it has no opening to the dummy body 67. The second manual operation box 65B has the same configuration as the second manual operation box 19B according to the first embodiment, except that it includes a communication member 70 to allow the pilot supply passage 40*a* to communicate normally with the second pilot output through hole 37*c* and to block communication between the second pilot output through holes 37*b* and 37*c*.

The other configuration of the second embodiment is the same as that of the first embodiment; therefore, the same main components in FIG. 6 have the same reference numbers; therefore, their descriptions are omitted.

In the pilot selector valve according to the second embodiment, when the solenoid 63*a* of the pilot solenoid valve 63 is de-energized, pilot fluid constantly supplied from the pilot supply channel ps to the second piston chamber 68*b* causes the valve body 26 to move toward the left in the figure, thereby causing the supply channel P to communicate with the second output opening 25B and the first output opening 25A to communicate with the first ejection channel EA (see the upper half of the valve body 26), and outputting compressed air from the second output port B. When the solenoid 63*a* is energized, pilot fluid is supplied to the first piston chamber 34*a* and the valve body 26 moves toward the right in the figure due to the difference in diameter between the first and the second pistons 35*a* and 69*b*, thereby causing the supply channel P to communicate with the first output opening 25A and the second output opening 25B to communicate with the second ejection channel EB (see the lower half of the valve body 26), and outputting compressed air from the first output port A. The operation performed when the first manual operation button 43*a* is pressed is the same as that in the first embodiment. In addition, the other action of the second embodiment is the same as in the first embodiment; therefore, its description is omitted.

In the first and the second embodiments, since each component has the same appearance, the required modification made to certain components enables common components to be used in both embodiments, thereby providing an inexpensive pilot selector valve.

What is claimed is:

1. A pilot selector valve that consists of a main valve with a valve body inserted into a valve hole in a valve body in which main valves can be connected on a connecting surface parallel to the axis of the valve hole; and pilot valves attached to one end of said valve body in the direction in which the valve hole is opened, said main valve allowing a pressurized fluid supply and ejection openings opened to the valve hole to communicate with supply and ejection channels that penetrate the valve body in the direction in which valve bodies are connected together, and allowing first and second output openings opened to the valve hole to communicate with output ports opened at the other end of the valve body in the direction in which the valve hole is opened, so that pilot fluid output from said pilot valve can be used to drive the valve body of the main valve to switch said first and the second output ports between the supply and the ejection channels for communication, wherein the first output opening in the valve body on the pilot valve mounting side is opened relative to a first output channel formed on the top surface of the valve body using a first enlarged channel with a square cross section and with its width in the axial direction of the valve hole sufficiently increased between sealants located on both sides of the output opening, wherein a through hole for allowing said first output channel to communicate with the first output port is opened in the valve body so that said first output channel formed by attaching a top cover to the valve body can be used to allow said first enlarged channel to communicate with said through hole, wherein said second output opening located opposite the first output channel is opened relative to the bottom surface of the valve body using a second enlarged channel similar to said first enlarged channel, and wherein a through hole for allowing said second enlarged channel to communicate with a second output port is opened in the valve body with the opening end of said second enlarged channel closed by a bottom cover attached to the bottom surface of the valve body.

2. A pilot selector valve according to claim 1 wherein the pilot valves attached to one end of the valve body in the direction in which the valve hole is opened are a first pilot valve for driving the valve body and a second pilot valve for causing the valve body to return.

3. A pilot selector valve according to claim 1 wherein in the top surface of the valve body, a pilot output through hole through which a pilot fluid output from the second pilot valve is introduced is formed relative to a second pilot output channel formed in parallel to the first output channel by attaching the top cover, and wherein a pilot output through hole is opened to allow said second pilot output channel to communicate with a piston chamber at the end of the valve body located opposite the pilot valve mounting side of the valve body.

4. A pilot selector valve according to any of claims 1 to 3 wherein the first enlarged channel has its width orthogonal to the connecting surface of the valve body, which is made larger than its width in the axial direction, and wherein the second enlarged channel is formed relative to the bottom surface of the valve body so that its width which is orthogonal to the connecting surface of the valve body is made larger than its width in the axial direction, as in said first enlarged channel.

5. A pilot selector valve according to any of claims 1 to 3 wherein a pilot supply channel that penetrate the valve body in the direction in which valve bodies are connected is formed in the valve body to supply pilot fluid to the pilot valves.

6. A pilot selector valve according to any of claims 1 to 3 wherein the bottom cover includes an engagement section that engages the valve body with a rail to connect valve bodies together.

* * * * *